US006240679B1

(12) United States Patent
Smalara

(10) Patent No.: US 6,240,679 B1
(45) Date of Patent: Jun. 5, 2001

(54) EASY TO CLEAN GUTTER SYSTEM

(76) Inventor: A. Christian Smalara, 5629 Mapleridge Dr., Madeira, OH (US) 45227

( * ) Notice: Subject to any disclaimer, the term of this patent is extended or adjusted under 35 U.S.C. 154(b) by 0 days.

(21) Appl. No.: 09/251,777

(22) Filed: Feb. 17, 1999

(51) Int. Cl.[7] ..... E04D 13/08

(52) U.S. Cl. ..... 52/16; 52/16; 52/13; 52/12; 52/11

(58) Field of Search ..... 52/11, 12, 16, 52/13

(56) References Cited

U.S. PATENT DOCUMENTS

| | | | | |
|---|---|---|---|---|
| 2,229,381 | * | 1/1941 | Grow | 52/12 |
| 4,199,121 | * | 4/1980 | Le Febvre | 52/12 |
| 4,311,292 | | 1/1982 | Deason | 248/48.2 |
| 4,561,616 | | 12/1985 | Robinson | 248/48.2 |
| 4,669,232 | | 6/1987 | Wyatt | 52/11 |
| 4,745,657 | | 5/1988 | Faye | 16/226 |
| 5,014,745 | * | 5/1991 | Watt | 52/16 |
| 5,146,718 | | 9/1992 | Baskett | 52/11 |
| 5,184,435 | | 2/1993 | Sherman | 52/12 |
| 5,317,843 | | 6/1994 | Sheeham | 52/11 |
| 5,335,460 | | 8/1994 | Smith, Jr. | 248/48.1 |
| 5,357,719 | | 10/1994 | Lewis | 52/11 |
| 5,417,015 | * | 5/1995 | Coyne | 52/11 |
| 5,526,611 | * | 6/1996 | Leahy | 52/16 |
| 5,649,681 | | 7/1997 | Faye | 248/48.1 |
| 6,085,466 | * | 7/2000 | Martin et al. | 52/13 |

* cited by examiner

*Primary Examiner*—Carl D. Friedman
*Assistant Examiner*—Chi Nguyen
(74) *Attorney, Agent, or Firm*—Mark F. Smith; Smith, Guttag & Bolin Ltd

(57) ABSTRACT

This invention is directed to rain gutters and, more particularly, to a gutter system for use with a dwelling that is easy to clean by an individual standing on the ground thereby alleviating the need for a ladder or an individual climbing upon the roof with the inherent dangers therewith. The gutter system of the present invention comprises an elongated gutter having an inner side wall, and outer side wall and a bottom extending between the lower end of the inner side wall and the lower end of the outer side wall; a bracket for mounting the gutter system to the fascia board of a dwelling and having a first hinge element; a hanger secured to the gutter and having a second hinge element for cooperating with the first hinge element of the bracket to permit rotational movement of the gutter, about a pivot axis that is directed along the upper end of said outer side wall, into an upright water-collecting configuration and into an inverted debris dumping configuration; and a cord for effecting rotation of the gutter. The location of the axis of rotation of the gutter along the upper end of the outer side wall of the gutter permits the gutter system to operate in a manner that will not be interfered with by overhanging shingles and may be used with dwellings requiring cornering gutters and will not detract from the appearance of the dwelling

18 Claims, 10 Drawing Sheets

EASY TO CLEAN GUTTER SYSTEM

BACKGROUND OF THE INVENTION

This invention is directed to rain gutters and, more particularly, to a gutter system for use with a dwelling that is easy to clean by an individual standing on the ground thereby alleviating the need for a ladder or an individual climbing upon the roof with the inherent dangers therewith.

Gutter systems for use with dwellings to channel water flowing off a roof generally comprise horizontal gutters for receiving the water, brackets for securing the gutters to the fascia boards near the eaves of the dwelling, and at least one down spout for channeling the collected water from the gutters to a drainage system leading away from the dwelling to a storm sewer or a discharge area. The gutters comprising such gutter systems, however, are often obstructed after a period of time by the accumulation of debris, such as leaves, twigs, roofing material, silt, and the like. Unless such cumulation of debris is periodically removed, water which is normally conducted through a gutter system will either overflow the gutter or be prevented from flowing into the gutter. Such water will often flow down the side of the dwelling and may result in mildew or structural damage. Further, water which is prevented from flowing into the gutter may accumulate and leak through the roof, particularly on a roof having a shallow pitch, into the interior of the dwelling.

One method of preventing debris from collecting within a gutter, is by the use of screens that are laid over the top of the gutter. However, while such screens do hinder the accumulation of debris in the gutter, they tend to clog over time and make the task of cleaning the gutter substantially more difficult. Further, if screens are used on a gutter which is located near trees, the screens often become covered with leaves and prevents or hinders water from flowing into the gutter during periods of heavy rain.

As a result of the tendency of a gutter to clog, various methods have been developed to clean a gutter. The most common method for cleaning a gutter is by manually climbing onto the roof or by the use of an extension ladder and removing the accumulated debris by hand or with the use of a hose, rake, or other similar device. This method, however, is relatively time consuming, strenuous, and often dangerous.

Another method for cleaning a gutter involves the use of specialized cleaning tools which are intended to be operated by a person standing on the ground below the gutter. Such tools typically comprise long poles that operate to push debris along the inside of the gutter until it can be scooped out using the tools or other devices. Unfortunately, because the operator is standing on the ground, the operator is unable to see inside the gutter thereby making such tools difficult and cumbersome to operate. Further, manipulation of the tools for removal of debris is often difficult and is substantially time consuming. While tools for cleaning a gutter have been developed for use by persons standing on the roof, the use of such tools requires the operator to be positioned at or near the edge of the roof where uneven footing, slippery roofing or loose shingles can make the use of such tools relatively dangerous.

In order to overcome some of the disadvantages of the prior methods of cleaning a gutter, gutter systems have been developed having rotatable gutters that operate to dump debris out. Unfortunately, until now, such gutter systems generally require a custom-built gutter or require relatively complicated pivoting mechanisms or detract from the appearance of the dwelling. Further, such gutter systems often rotate the gutter in such a manner that makes them unsuitable for use on older houses having overhanging shingles or eaves that can interfere with the rotation of the gutter or results in water and cumulated debris being dumped against the side of the dwelling.

Accordingly, a need exists for an improved gutter system that permits easy cleaning and removal of debris from a gutter, that is relatively safe and easy to operate, that is relatively simple in design and inexpensive to manufacture, that is relatively simple to install, that can be used on new or older homes having overhanging eaves, and does not detract from the appearance of the dwelling.

SUMMARY OF THE INVENTION

The present invention is directed to an easy to clean gutter system for use on a dwelling. The gutter system comprises an elongated gutter having an inner side wall, an outer side wall, and a bottom thereby forming an elongated channel there between for receiving water runoff from a roof, a bracket for mounting the gutter to the dwelling; and a hanger secured to the gutter and pivotally mounted to the bracket to permit rotational movement of the gutter, about a pivot axis along the upper end of the outer side wall of the gutter, into an upright water-collecting configuration and into an inverted debris dumping configuration.

In another preferred embodiment of the invention, the gutter system comprises a multiple eyelet system for effecting rotational movement of the gutter.

In another preferred embodiment of the invention, the gutter system comprises means for effecting rotation of the gutter by an operator positioned on the ground.

In another preferred embodiment of the invention, the gutter system comprises a gutter formed from individual sections.

In another preferred embodiment of the invention, the gutter system comprises a down spout separated from the gutter to permit the gutter to freely rotate.

In another preferred embodiment of the invention, the gutter system comprises a gutter having non-rotating corner sections.

In another preferred embodiment of the invention, the gutter system comprises bridges for connecting a rotatable gutter section to a stationary corner section.

In another preferred embodiment of the invention, the gutter system comprises a gutter mounted for rotational movement away from the dwelling from an upright water-collecting configuration into an inverted debris dumping configuration.

In another preferred embodiment of the invention, the gutter system comprises a mesh screen overlying the gutter.

Therefore, a primary object of this invention is to provide a new and novel gutter system that may be easily cleaned.

Another primary object of this invention is to provide a new and novel gutter system having a gutter which can be cleaned by a person standing on the ground.

Another primary object of this invention is to provide a new and novel gutter system having a gutter which can be easily rotated from an upright water-collecting configuration into an inverted debris dumping configuration.

Another primary object of this invention is to provide a new and novel gutter system which can incorporate conventional gutters.

Another primary object of this invention is to provide a new and novel gutter system which does not detract from the appearance of the dwelling.

Another primary object of this invention is to provide a new and novel gutter system which can be used on older dwellings having overhanging shingles or eaves.

Another primary object of this invention is to provide a new and novel gutter system which is relatively simple in design.

Another primary object of this invention is to provide a new and novel gutter system which is relatively inexpensive to manufacture.

These and other objects and advantages of the invention will be apparent from the following description, the accompanying drawings and the appended claims.

BRIEF DESCRIPTION OF THE PREFERRED EMBODIMENT

Figure 1:
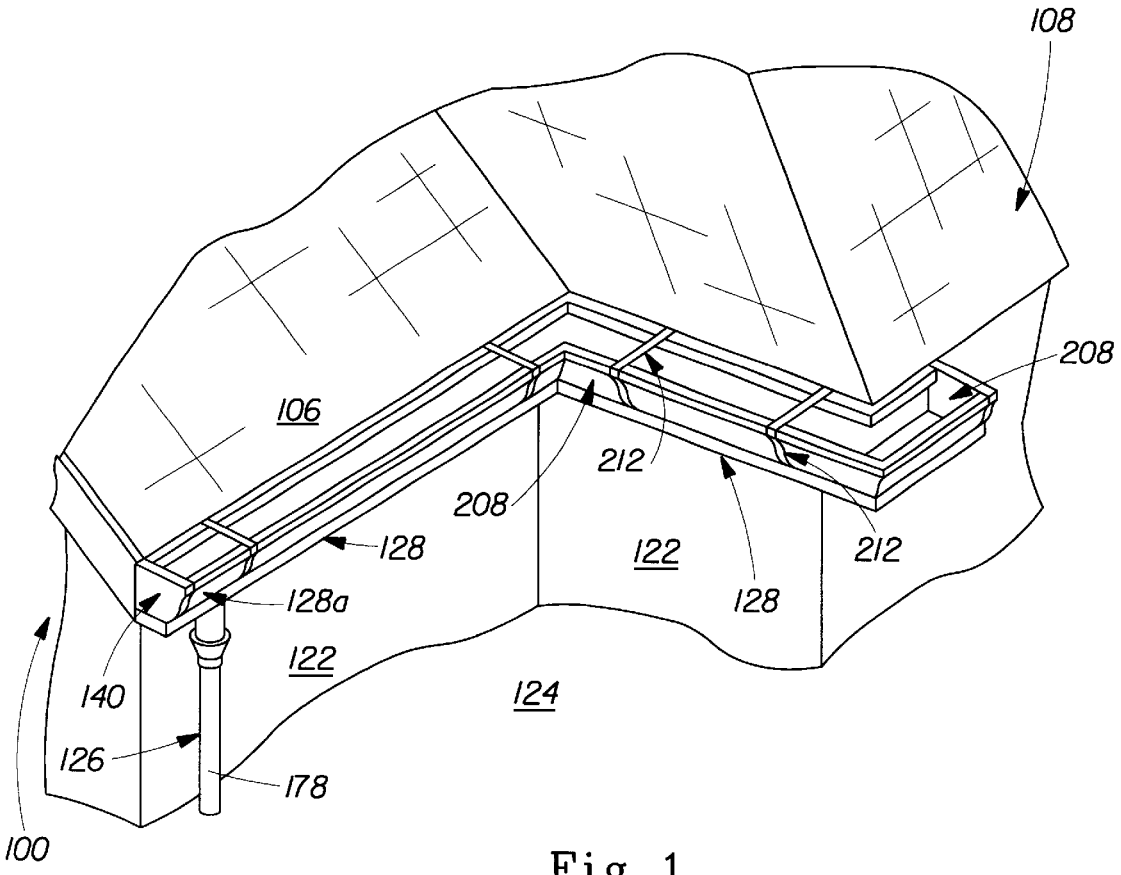
FIG. 1 is a partial perspective view of the easy to clean gutter system of the present invention secured to the fascia of a dwelling and shown in its upright water-collecting configuration.
Figure 2:
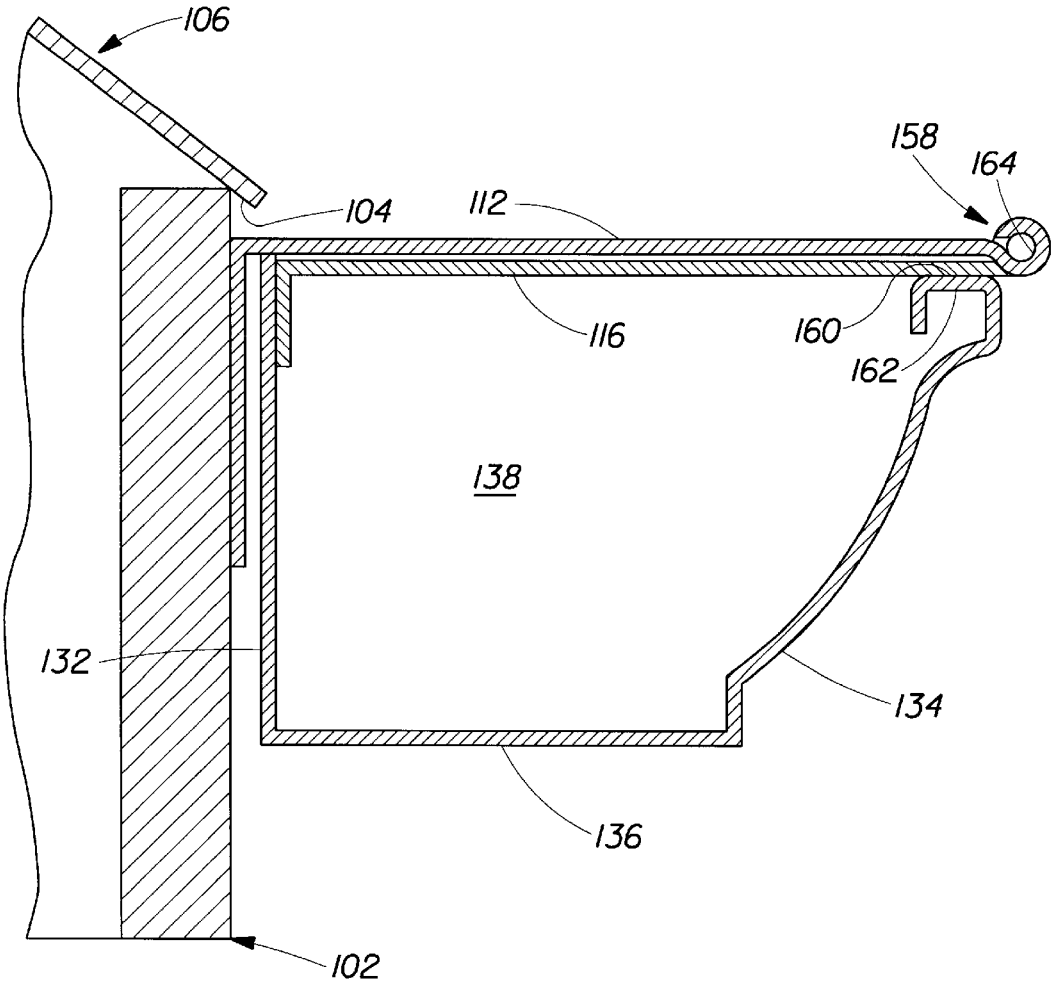
FIG. 2 is a sectional elevation view of the easy to clean gutter system of the present invention shown in the upright water-collecting configuration.
Figure 3:
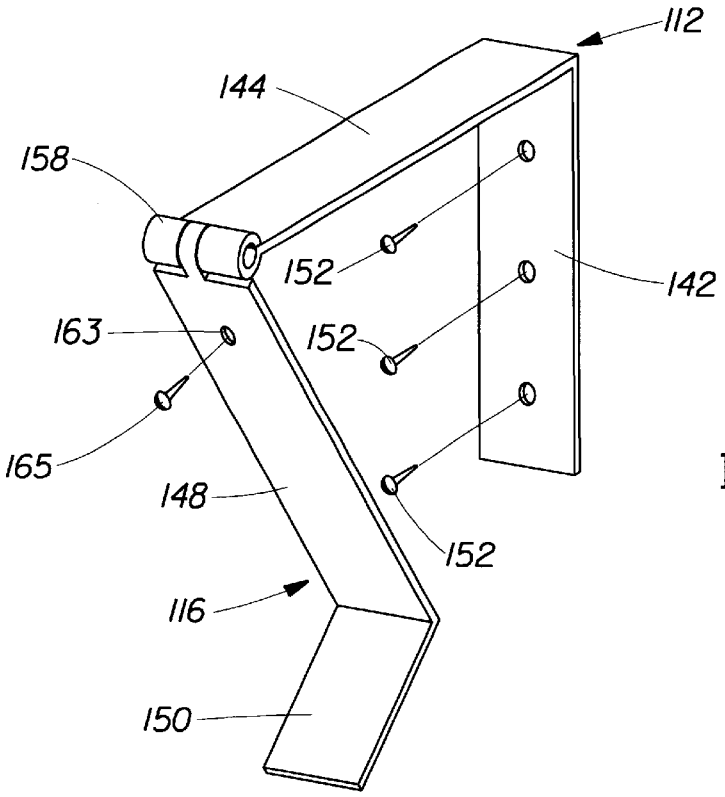
FIG. 3 is a detailed perspective view of the bracket and hanger components, as shown in FIGS. 1 and 2, of the easy to clean gutter system of the present invention.

Referring to FIGS. 1 and 2, the easy to clean gutter system of the present invention, generally designated 100, is shown horizontally mounted on a fascia board 102 beneath the shingle overhang 104 of a roof 106 of a dwelling 108. It should be understood to those skilled in the art that the dwelling 108 may be any structure or building, residential or commercial, which utilizes a gutter system with or without down spouts. The gutter system 100 is shown in its usual upright configuration for receiving rain or water flowing off the roof 106 and comprises an elongated gutter 110; a bracket 112 (FIGS. 3 and 4) for mounting the gutter system 100 to the fascia board 102 and having a first hinge element 114 (FIG. 4); a hanger 116 (FIGS. 3 and 4) secured to the gutter 110 and having a second hinge element 118 (FIG. 4) for cooperating with the first hinge element 114 (FIG. 4) of the bracket 112 to permit rotational movement of the gutter 110 into an upright water-collecting configuration (FIG. 2) and into an inverted debris dumping configuration (FIG. 7); and a cord 120 (FIG. 8) for effecting rotation of the gutter 110.

As used herein, the terms "vertical" or "vertically" corresponds to the plane substantially parallel to the side 122 of the dwelling 108; the term "horizontal" or "horizontally" refers to the plane substantially perpendicular to the side 122 of the dwelling 108; the terms "downward" or "downwardly" corresponds to a direction towards and generally perpendicular to the ground 124; and the terms "upward" or "upwardly" correspond to a direction away from and generally perpendicular to the ground 124.

Figure 4:
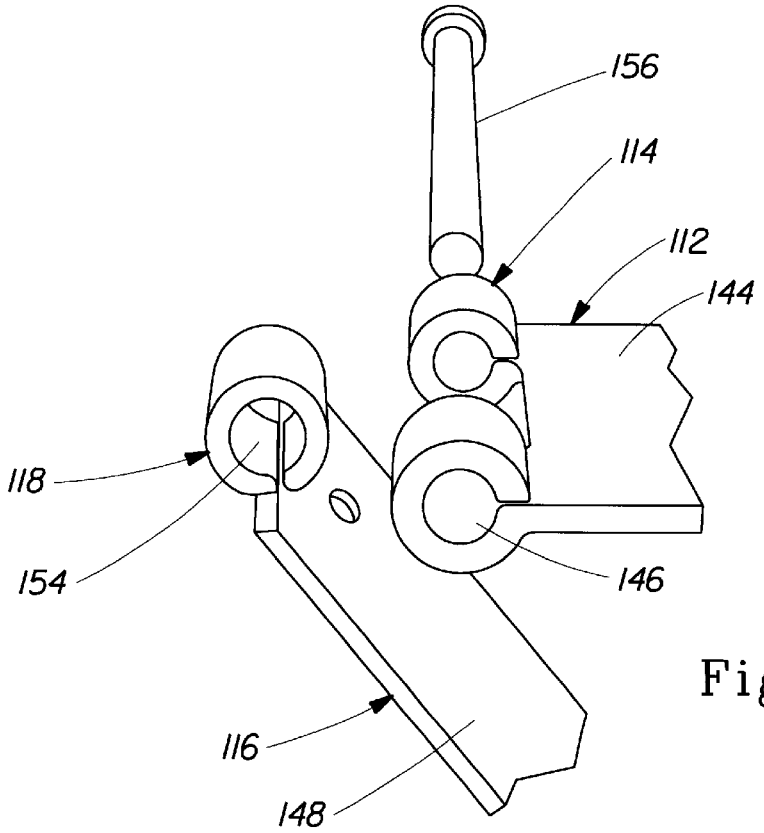
FIG. 4 is a detailed exploded perspective view of the hinge elements of the bracket and hanger components, as shown in FIG. 3, of the easy to clean gutter system of the present invention.

The gutter 110, which runs parallel to the edge of the roof 106 and empties into a down spout 126, is conventionally formed from individual sections 128, preferably extruded from an appropriate plastic or metal, such as aluminum, joined together by a conventional joiner 130. Referring to FIGS. 1 and 2, each individual section 128 has a conventional cross section comprising opposed, generally vertically disposed, substantially parallel, laterally spaced inner and outer side walls 132, 134, respectively, and a bottom 136 extending between the lower end of the inner side wall and the lower end of the outer side wall 134 thereby forming an elongated channel 138 there between for receiving water runoff from the roof 106. The ends of the gutter 110 include end caps 140 each having substantially the same cross-sectional configuration as the gutter 110. As show in FIGS. 1, 2, 3 and 4, the gutter 110 is suspended along the fascia boards 102 near the shingle overhangs 104 of the roof 106 by the generally L-shaped brackets 112 each having a substantially vertical disposed, elongated first leg 142, which is fastened as by screws, nails, or the like, to the fascia board 102, and a substantially horizontal disposed, elongated second leg 144 extending substantially perpendicularly from the first leg 142 and away from the fascia board 102 and terminating in the first hinge element 114 having a slot 146 therein (FIG. 4). The hangers 116 are similar in construction to the bracket 112 and have a generally L-shape comprising a first leg 148 extending across the top of the gutter 110 and a second leg 150 extending substantially perpendicularly from the first leg 148 of the hanger 116 and secured to the inner side wall 132 of the gutter 110 by fasteners 152, such as by screws or rivets. The outer end of the first leg 148 of each hanger 116 terminates in the second hinge element 118 and includes a slot 154 (FIG. 4) which is coupled to the slot 146 of the first hinge element 114 of a respective bracket 112 by a pin 156 thereby forming a hinge 158 and providing a pivot axis 164 directed along the upper end of the outer side wall 134 of the gutter 110. The hanger 116 further provides a seat for cooperating with the shoulder portion 160 of an inwardly bent lip 162 formed along the upper end of the outer side wall 134, and includes an aperture 163 for receiving a screw, rivet, or the like 165 to secure the outer side wall 134 to the shoulder portion 160 to support the gutter 110.

Figure 5:
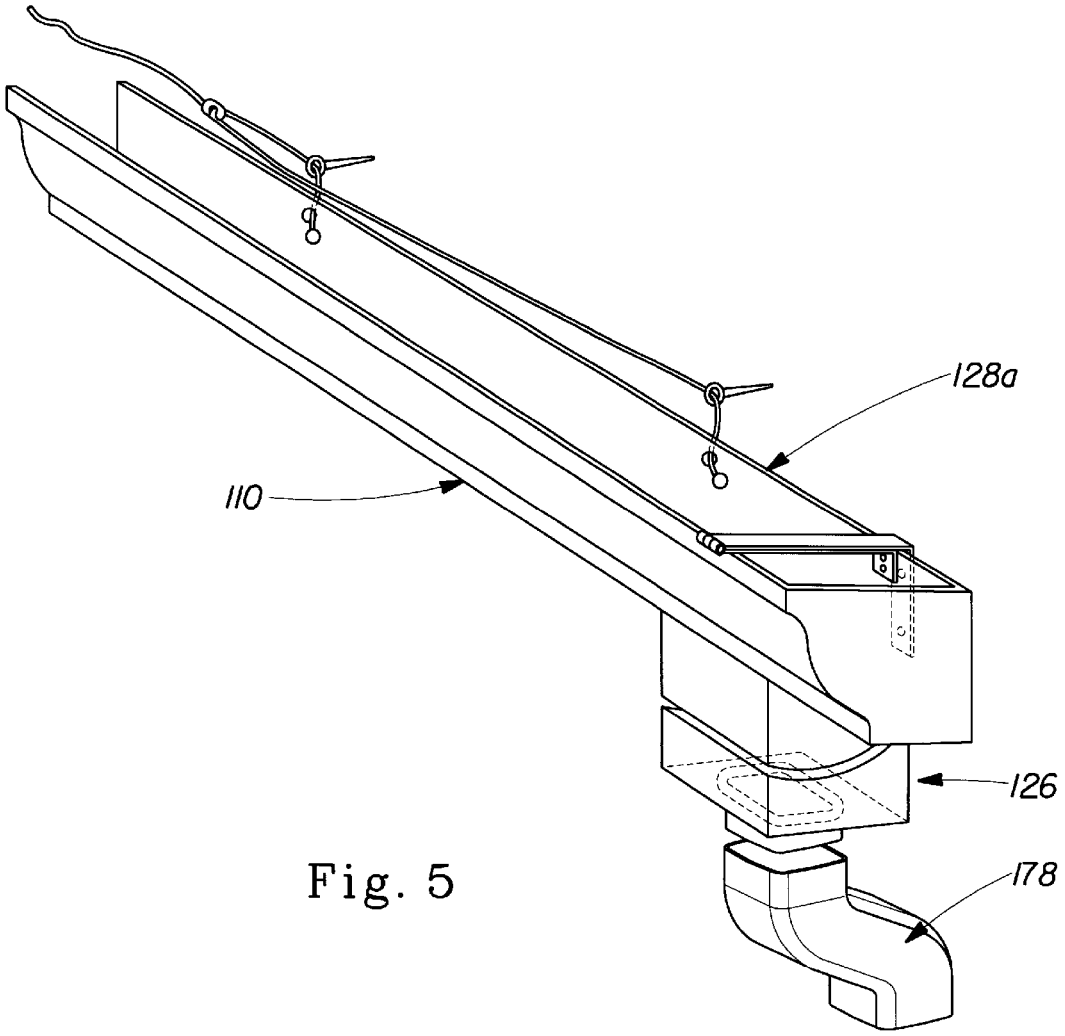
FIG. 5 is a partial perspective view of the down spout of the easy to clean gutter system of the present invention.
Figure 6:
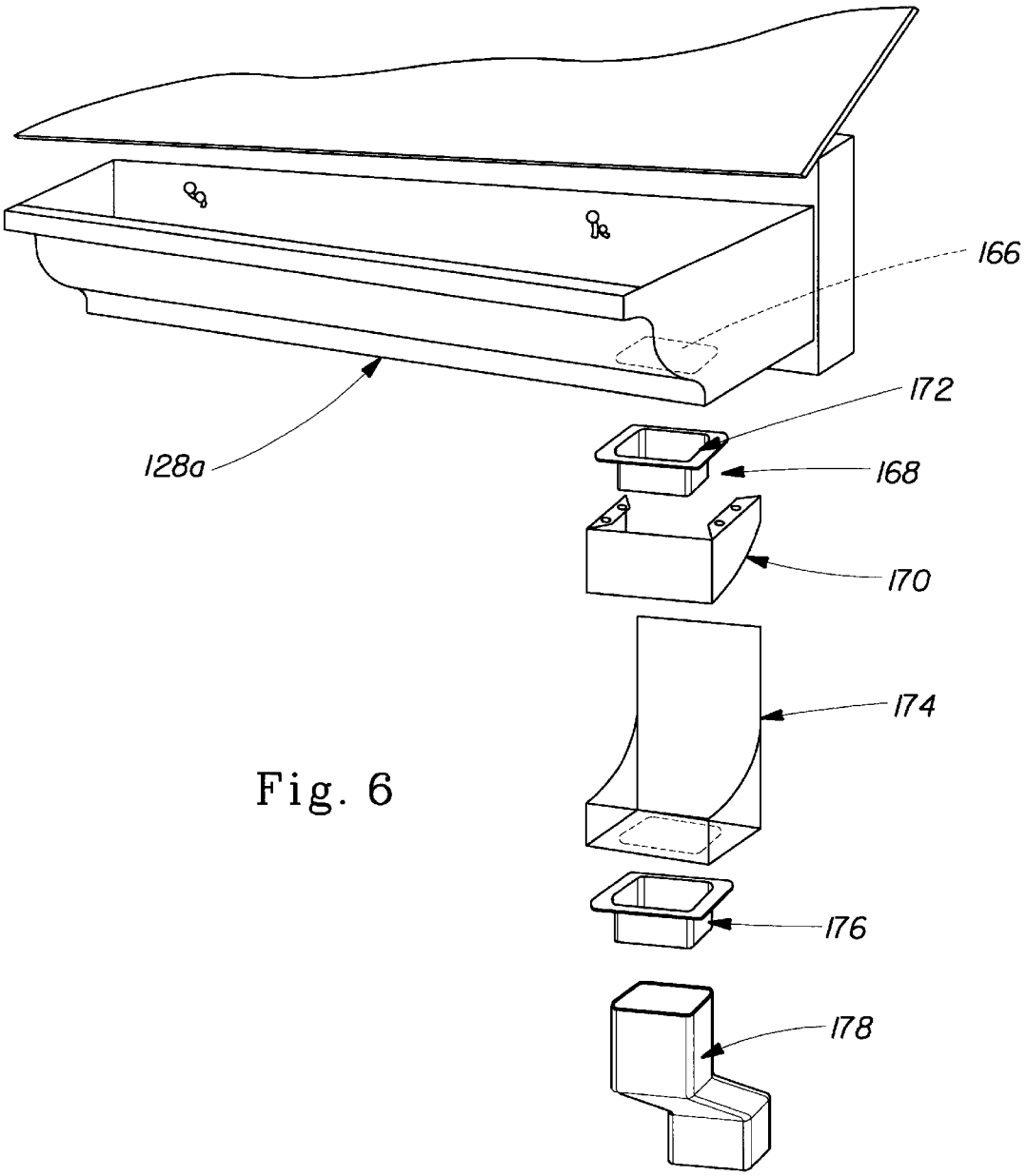
FIG. 6 is a partial, partially exploded, perspective view of the down spout, as shown in FIG. 5, of the easy to clean gutter system of the present invention.

The gutter system 100 is provided with at least one individual gutter section 128*a* configured for discharging collected water from the gutter 110 to at least one down spout 126. The down spout 126 is effective for channeling the collected water from the gutter 110 to a drainage system (not shown) that leads away from the dwelling 108 to a storm sewer or a discharge area (not shown). To accommodate the rotation of the gutter 110, the downs spout 126 is not directly attached to the gutter 110 but is separated to permit the gutter 110 to freely rotate away from the down spout 126. Referring to FIGS. 5 and 6, the individual gutter section 128*a* configured for discharging collected water from the gutter 110 to the down spout 126 includes an aperture 166 for receiving a first tubular drop 168 having a shield 170 for deflecting water through the down spout 126 and for improving the appearance of the gutter system 100. The first tubular drop 168 includes a lip 172 for retaining the tubular drop 168 within the aperture 166 and for providing a water seal. A collection basin 174, configured to mate with the shield 170 when the gutter 110 is in its upright water-collecting configuration, has a second tubular drop 176 for receiving the upper end of a down spout tube 178, is securely mounted to the side 122 of the dwelling 108 in a spaced apart and vertically aligned arrangement, and in fluid communication with the first tubular drop 168 when the gutter 110 is in its upright water-collecting configuration.

Figure 8:
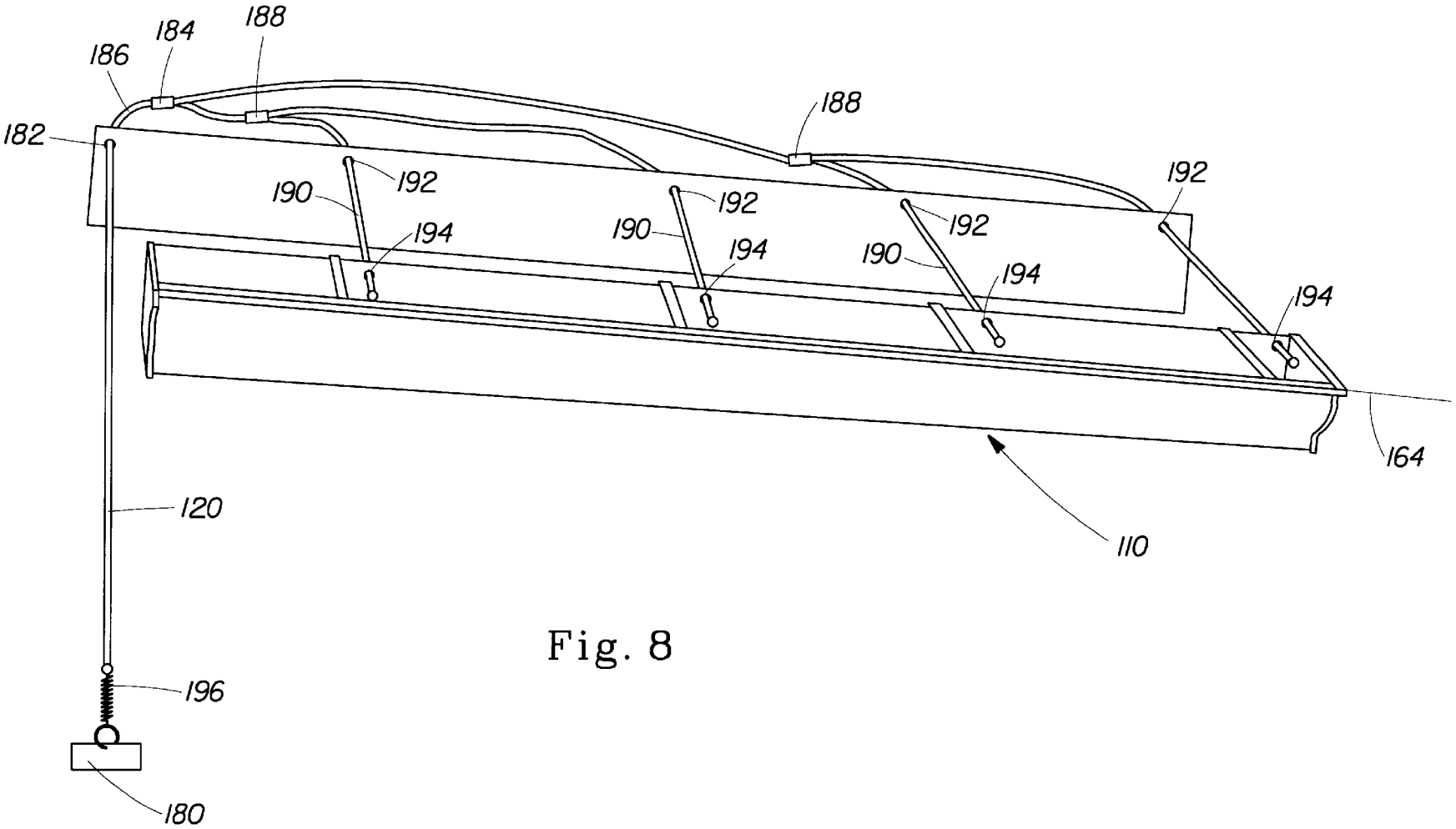
FIG. 8 is a partial perspective view showing the pulley system of the present invention for rotating the easy to clean gutter system of the present invention into an upright water-collecting configuration and into an inverted debris-dumping configuration.

Referring to FIG. 8, the gutter 110 is held in its upright rain collecting configuration by the cord 120 having one end secured to a cleat 180 and its other end secured to a primary stationary eyelet 182. The primary eyelet 182 is coupled to a secondary eyelet 184 though a line 186. The secondary eyelet 184 is secured to a first pair of movable eyelets 188. In turn, the first pair of movable eyelets 188 is coupled to the gutter 110 through lines 190 which are connected to the first pair of movable eyelets 188 and pass through stationary eyelets 192, that longitudinally extend horizontally along the fascia board 102 and upwardly therefrom, and are secured to the upper edge of the inner side wall 132 of the gutter 110 to create lifting points 194. It should now be apparent to one skilled in the art that the use of the multiple eyelet system of the present invention permits equal forces to be applied to the lifting points and permits additional lifting points to be created by securing lines to the first pair of secondary eyelets and attaching additional secondary eyelets to such lines and by running additional lines around the additional secondary eyelets and securing such lines to the gutter. Further, it should also now be apparent that this sequence of eyelets and lines may be repeated as necessary to accommodate different lengths of gutter. It should also now be apparent to those skilled in the art that other methods may be used to rotate the gutter. For example, the eyelet system can be replaces by a pulley system or by electric motor means without departing from the scope of the invention.

Figure 7:
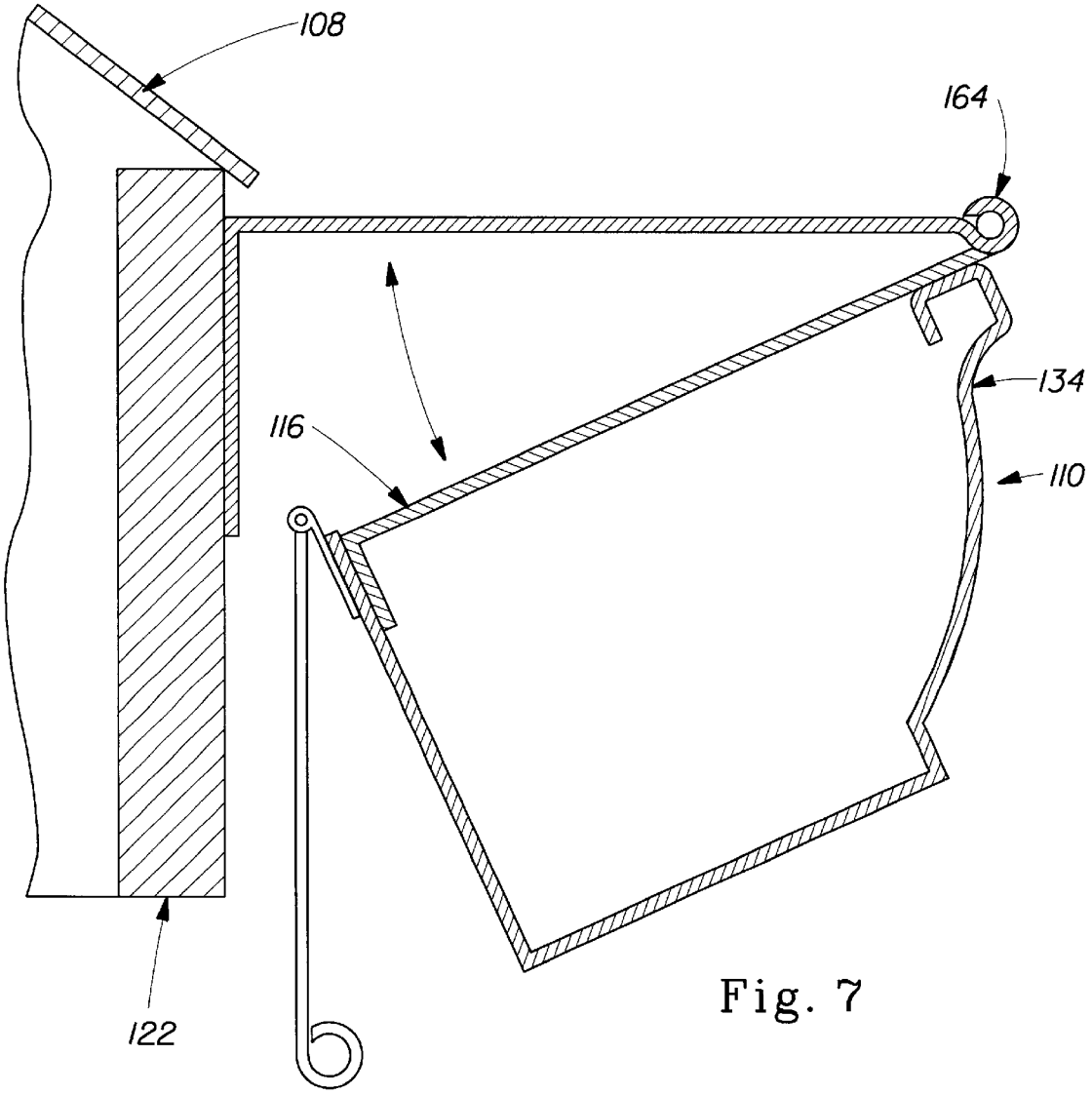
FIG. 7 is a sectional elevation view of the easy to clean gutter system of the present invention shown in the inverted debris-dumping configuration.
Figure 9:
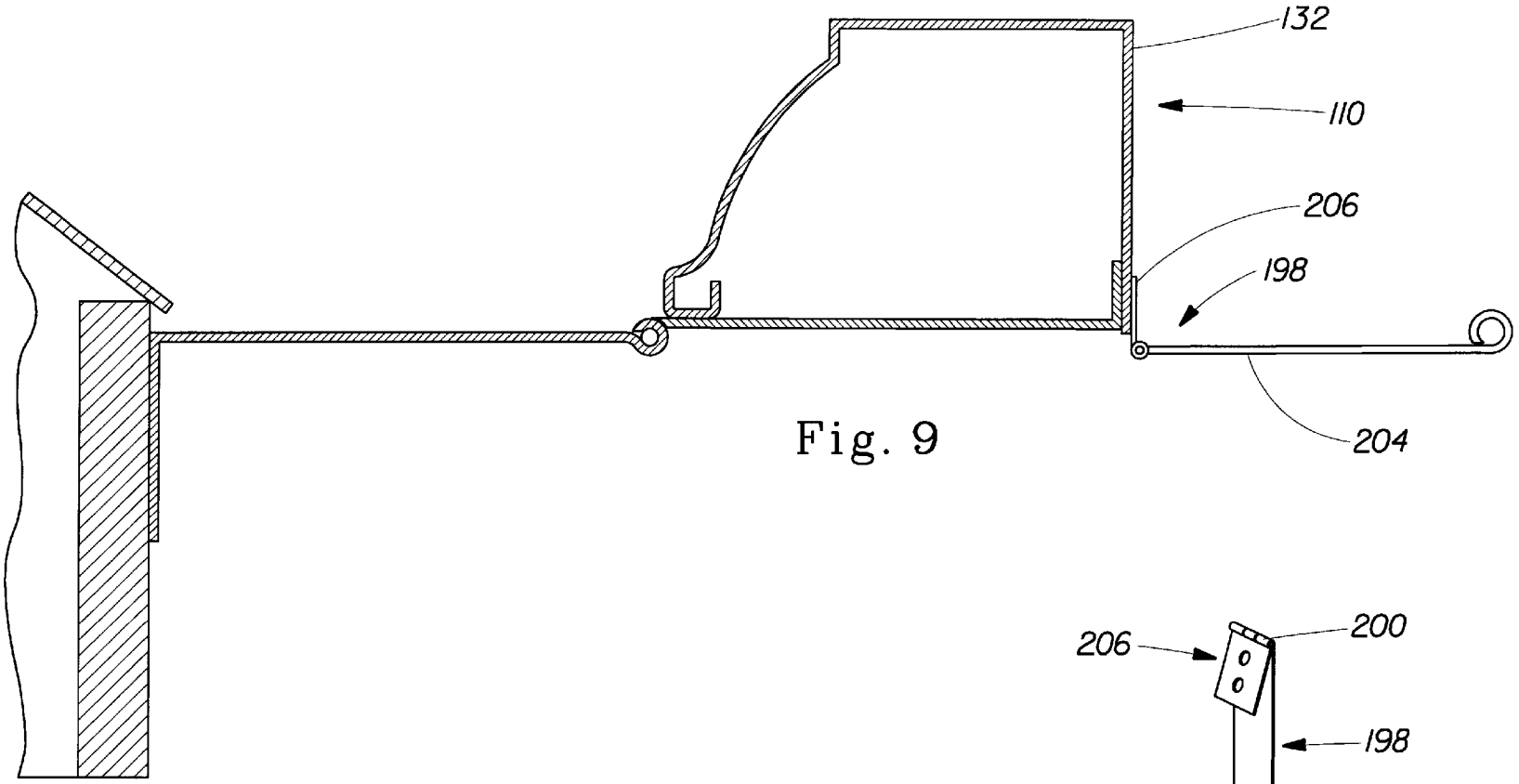
FIG. 9 is a schematic side view of a preferred embodiment of a cord and pull hinge apparatus for rotating the gutter into a filly inverted debris-dumping configuration.
Figure 10:
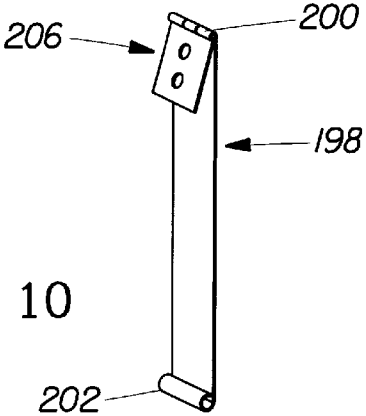
FIG. 10 is a detailed perspective view of the pull hinge of FIG. 8.
Figure 11:
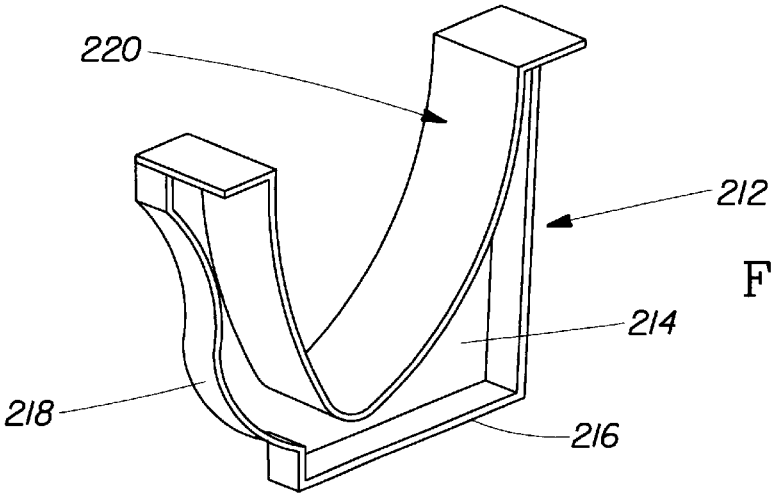
FIG. 11 is a detailed perspective view of a first side of a bridge for mating with a rotatable individual gutter section and joining same to a non-rotatable corner section, as shown in FIGS. 1 and 2, of the easy to clean gutter system of the present invention.

In operation, the gutter 110 is held in its upright water-collecting configuration, as shown in FIG. 1, by the pull of the cord 120. A spring 196 is provided to maintain pull on the cord 120. In order to initiate the dumping of accumulated debris and cleaning of the gutter 110, the cord 120 is released by an operator positioned on the ground 124 thereby permitting the weight of the gutter 110 to pull on the line 186 thereby moving the secondary eyelet 184 and the movable eyelets 188 in a direction toward the primary stationary eyelet 182 thereby relaxing the pull of lines 190 to cause hanger 116 to pivot thereby effecting rotation of the gutter 110 about a pivot axis 164 (FIG. 2) directed along the upper end of the outer side wall 134 of the gutter 110, away from the side 122 of the dwelling 108, and through about 90 degrees of circular arc into an inverted position as shown in FIG. 7. The operator standing on the ground 124 may then manually rotate the gutter 110 using a pull hinge apparatus 198 (FIGS. 9 and 10) through about an additional 90 degrees of circular arc thereby fully inverting the gutter and emptying it of water and debris. The pull hinge apparatus 198 of the present invention, as shown in FIGS. 9 and 10, comprises a hinge 200 having a hook or loop 202 at one end for securing a cord 204 thereto and a pivotal mounting plate 206 for attaching to the inner side wall 132 of the gutter 110 by fasteners, such as screws, rivets, and the like. It should now be apparent to those skilled in the art that other apparatus for engaging and disengaging with the hook or loop 202, such as poles, may be used for effecting full rotation of the gutter without departing from the scope of the invention.

For rotating the gutter back into its upright water-collecting configuration, the cord 120 is pulled downwardly thereby moving the secondary eyelet 184 and movable eyelets 188 to move in a direction away from the primary stationary eyelet 182 thereby pulling on lines 190 to pull upwardly on the gutter 110 along the lifting points 194 to effect rotation of the gutter 110 back into its upright water-collecting configuration. The cord 120 can then be secured to the cleat 180 which cooperates with the spring 196 to maintain a pull on the cord 120 to secure the gutter 110 in its upright water-collecting configuration. It should be apparent to those skilled in the art that while the preferred means for maintaining and returning the gutter 110 in its upright water-collecting configuration is by a cord, other means, including the use of ropes, wires, chains, rods, sticks, electric motor means, and the like, may be utilized without departing from the scope of the invention.

Figure 12:
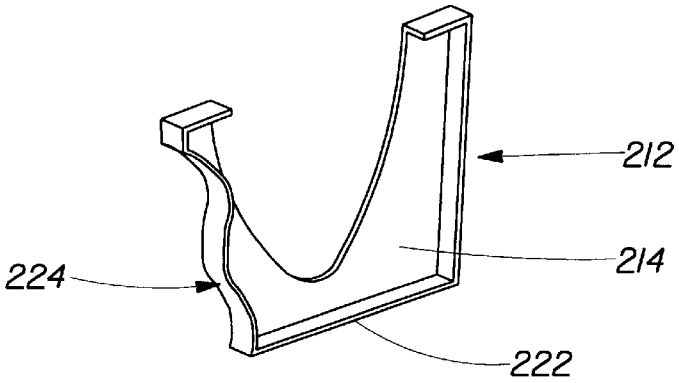
FIG. 12 is a detailed perspective view of a second side of the bridge of FIG. 11 for mating with the non-rotating corner section.
Figure 13:
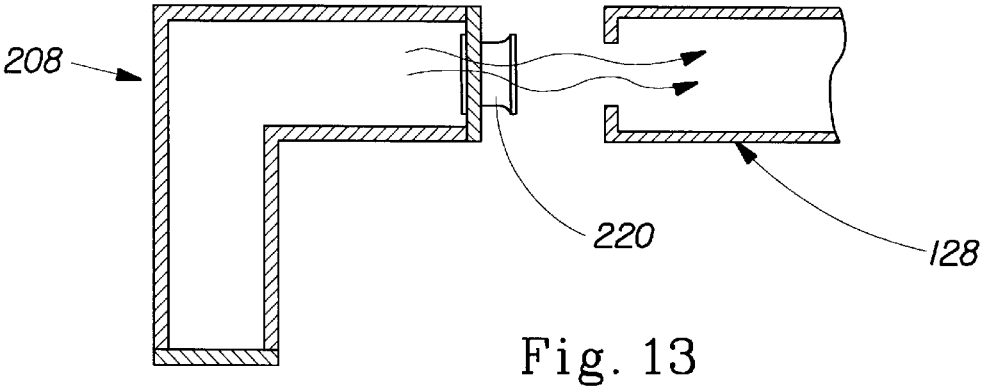
FIG. 13 is a schematic top view of the bridge of FIG. 10 for joining a rotatable individual gutter section to a non-rotatable corner section of the easy to clean gutter system of the present invention.

In another preferred embodiment of the invention, the gutter system 100, as shown in FIG. 1, further comprises non-rotating angular gutter sections 208 for directing the gutter 110 around a corner, generally designated 210, of the dwelling 108. As shown in FIGS. 1, 11, 12 and 13, the angular gutter sections 208 include bridges 212 that extend between an individual gutter section 128 and a mutually aligned, closely-spaced angular gutter section 208. As shown in more detail in FIGS. 11 and 12, a bridge 212 comprises a web portion 214 and an outer lip 216. The outer lip 216 has an outer surface 218 that approximates the inner surface of the angular gutter section 208 and is slightly smaller in size than the inner periphery of the angular gutter section 208 to permit the outer lip 216 to extend into and nest within the opposite end portion of the adjacent angular gutter section 208 to form a slip joint. The web portion 214 is provided with an inner lip 220 that extends outwardly for extending into the channel 138 (FIG. 13) formed in the individual gutter section 128. As shown in FIG. 12, the web portion 214 includes a second outer lip 222 having an outer surface 224 that approximates the inner surface of the individual gutter section 128 and is slightly smaller in size than the inner periphery of the individual gutter section 128 to permit the second outer lip 222 to extend into and nest within the opposite end portion of the adjacent individual gutter section 128 to form a slip joint. The inner lip 220 has a generally U-shaped cross-section that permits water to flow across the bridge between the stationary angular gutter section 208 and the adjacent individual gutter section 128. In operation, the bridges 212 are secured to the non-rotating angular gutter section 208 and freely rotates into and out of their nested position within the adjacent individual gutter section 128.

Those skilled in the art will now recognize that the location of the axis of rotation of the gutter of the present invention, along the upper end of the outer side wall of the gutter, permits the gutter to rotate freely from an upright water-collecting configuration and into an inverted debris dumping configuration and vice versa. It should also now be recognized to those skilled in the art that the location of the axis of rotation of the gutter of the present invention, along the upper end of the outer side wall of the gutter, permits the gutter system to operate in a manner that will not be interfered with by overhanging shingles. It should also now be recognized to those skilled in the art that the present invention may be used with dwellings requiring cornering gutters and will not detract from the appearance of the dwelling. It should also be apparent to those skilled in the art that the gutter system of the present invention can be easily adopted for use with conventional gutters.

Figure 14:
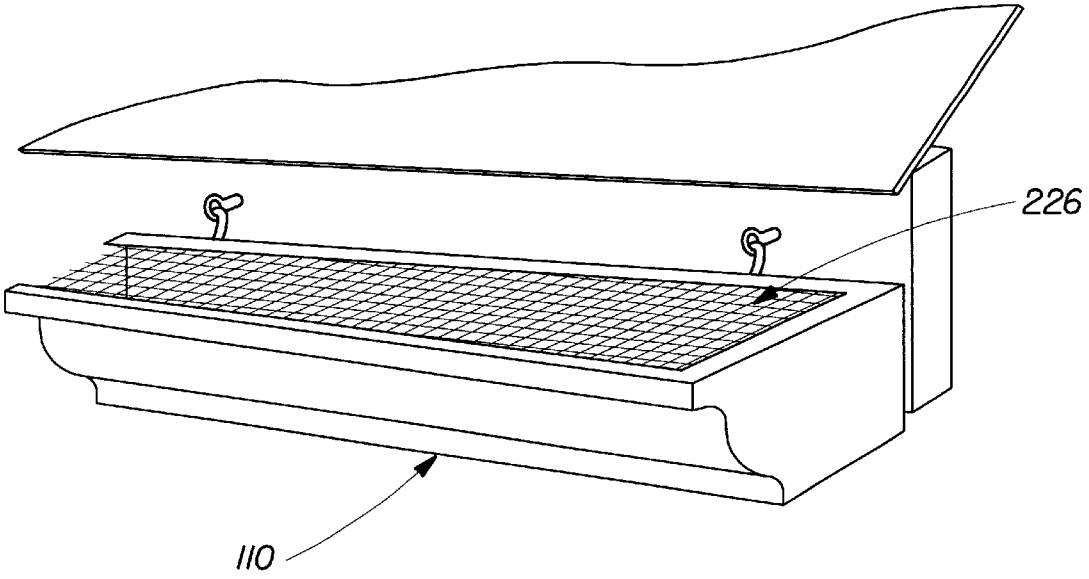
FIG. 14 is a partial perspective view of another embodiment of the easy to clean gutter system of the present invention showing a gutter having a screen mounted thereon.

Referring to FIG. 14, another preferred embodiment of the present invention is shown whereby a mesh screen 226 is provided over the top of the gutter 110, or only along the non-rotating angular gutter sections, to prevent debris from entering and collecting within the elongated channel 138. The mesh screen 226 is conventionally mounted along the gutter 110 by conventional attaching means, such as wire, clamps, clips, and the like, that secures the mesh screens 226 to the second leg 144 of the individual hangers 114. It should now be apparent to those skilled in the art that the method of rotation of the present invention, as previously described, will not interfere with the mesh screen. In addition, rotation of the gutter into the inverted debris dumping configuration, permits the mesh screens to be easily cleaned by an individual on the ground.

Accordingly, the present invention provides an improved gutter system that permits easy cleaning and removal of debris from the gutter, that is relatively safe, dependable, and easy to operate, that is relatively simple in design and inexpensive to manufacture, that is relatively simple to install, that can be used on new or older homes having overhanging shingles or eaves, and does not detract from the appearance of the dwelling.

While the forms of apparatus described herein constitute preferred embodiments of the present invention, it is to be understood that the invention is not limited to these precise forms of apparatus, and that changes, including variations in size, materials, shape, form, function or manner of operation, may be made therein without departing from the scope of the invention which is defined in the appended claims.

What is claimed is:

1. A gutter system for use with a dwelling comprising:

an elongated gutter comprising an inner side wall having an upper end and a lower end, an outer side wall having an upper end and a lower end, and a bottom extending between said lower end of said inner side wall and said lower end of said outer side wall;

means for mounting said gutter to the dwelling;

means for permitting said gutter to rotate about a pivot axis that is directed along the upper end of said outer side wall; and means for maintaining said gutter in an upright water collecting configuration and for permitting the weight of said gutter to cause rotation of said gutter about said pivot axis into position for rotating into an inverted debris dumping configuration.

2. The gutter system of claim 1 further comprising means for effecting rotational movement of said gutter into said inverted debris dumping configuration and into said upright rain collecting configuration.

3. The gutter system of claim 2 further comprising a down spout for channeling collected water from said gutter to a drainage system, wherein said down spout is not attached to said gutter.

4. The gutter system of claim 1 further comprising a mesh screen over the top of said gutter to prevent debris from entering and collecting within said gutter.

5. A gutter system for use with a dwelling comprising:

an elongated gutter having an inner side wall having an upper end and a lower end, an outer side wall having an upper end and a lower end, and a bottom extending between said lower end of said inner side wall and said lower end of said outer side wall;

a bracket for mounting said gutter to the dwelling, said bracket having a first hinge element;

a hanger secured to said gutter, said hanger having a second hinge element;

whereas said first hinge element cooperates with said second hinge element to permit said gutter to rotate about a pivot axis directed along the upper end of said outer side wall; and whereas the weight of said gutter causes rotation of said gutter about said pivot axis into position for rotating said gutter into an inverted debris dumping configuration.

6. The gutter system of claim 5 whereas said outer side wall comprises an inwardly bent lip having a shoulder portion for cooperating with said first hinge element and said second hinge element to support said gutter and to rotate said gutter about said pivot axis.

7. The gutter system of claim 6 further comprising a pulley system for effecting rotational movement of said gutter.

8. The gutter system of claim 5 further comprising an aperture in said bottom of said gutter and having a tubular drop, and a down spout for channeling collected water from said gutter to a drainage system, said down spout having a collection basin in a spaced apart and vertically aligned arrangement and in fluid communication with said tubular drop when said gutter is in an upright water-collecting configuration.

9. The gutter system of claim 5 further comprising a mesh screen over the top of said gutter to prevent debris from entering and collecting within said gutter.

10. A gutter system for use on a dwelling comprising:

an elongated gutter for collecting water having an inner side wall having an upper end and a lower end, an outer side wall having an upper end and a lower end, and a bottom extending between said lower end of said inner side wall and said lower end of said outer side wall;

a bracket for mounting said gutter to the dwelling, said bracket having a first hinge element;

a hanger secured to said gutter and having a second hinge element for cooperating with said first hinge element to permit rotational movement of said gutter about a pivot axis directed along the upper end, of said outer side wall such that said gutter rotates into an upright water-collecting configuration and into an inverted debris dumping configuration, whereas the weight of said gutter causes rotation of said gutter about said pivot axis into position for rotating said gutter into an inverted debris dumping configuration; and means for effecting rotation of said gutter comprising a system of lines secured to said gutter whereby said lines operate to rotate said gutter into the upright water-collecting configuration.

11. The gutter system of claim 10 whereas said gutter system further comprises a pull hinge apparatus for rotating the gutter into a fully inverted position.

12. The gutter system of claim 10 further comprising an eyelet system for effecting rotational movement of said gutter.

13. The gutter system of claim 10 further comprising a down spout for channeling collected water from said gutter to a drainage system.

14. The gutter system of claim 10 further comprising a mesh screen over the top of said gutter to prevent debris from entering and collecting within said gutter.

15. The gutter system of claim 12 whereas said eyelet system comprises a primary eyelet, at least one secondary eyelet and a cord; whereas said primary eyelet is coupled to each said secondary eyelet; whereas said secondary eyelets are coupled to said gutter; and whereas said cord is secured to said primary eyelet for effecting rotation of said gutter.

16. The gutter system of claim 10 further comprising a down spout separated from said gutter for channeling collected water from said gutter to a drainage system, said down spout being positioned in such a manner that it wall not interfere with rotation of said gutter.

17. The gutter system of claim 10 further comprising at least one angular gutter section for directing said gutter around a corner, whereas said angular gutter section is non-rotating.

18. The gutter system of claim 10 whereas said gutter further comprises a non-rotating section, a rotating section, and a bridge for connecting a said non-rotating section to said rotating section.

* * * * *